US006679469B1

(12) United States Patent
Vega

(10) Patent No.: US 6,679,469 B1
(45) Date of Patent: Jan. 20, 2004

(54) BREAKAWAY SIGN STAND

(75) Inventor: Peter Vega, Jacksonville, FL (US)

(73) Assignee: Florida Department of Transportation, Tallahassee, FL (US)

( * ) Notice: Subject to any disclaimer, the term of this patent is extended or adjusted under 35 U.S.C. 154(b) by 0 days.

(21) Appl. No.: 10/193,007

(22) Filed: Jul. 11, 2002

(51) Int. Cl.[7] ..... E01F 9/018
(52) U.S. Cl. ..... 248/548; 52/98; 40/607
(58) Field of Search ..... 248/548; 52/98, 52/99; 40/607, 608, 609

(56) References Cited

U.S. PATENT DOCUMENTS 3,628,296 A * 12/1971 Henry ..... 52/98
4,126,403 A * 11/1978 Sweeney et al. ..... 403/2
4,928,446 A * 5/1990 Alexander, Sr. ..... 52/98
5,125,194 A * 6/1992 Granger ..... 52/98
5,788,405 A * 8/1998 Beard ..... 404/10
5,794,910 A * 8/1998 Granger ..... 248/548
5,887,842 A * 3/1999 Granger ..... 248/548
5,957,425 A * 9/1999 Conway et al. ..... 248/548
6,068,233 A * 5/2000 Green ..... 248/548
6,113,055 A * 9/2000 Salman ..... 248/548
6,457,895 B1 * 10/2002 Salman ..... 403/2

* cited by examiner

*Primary Examiner*—Ramon O. Ramirez
*Assistant Examiner*—Steven Marsh
(74) *Attorney, Agent, or Firm*—John Wiley Horton

(57) ABSTRACT

A modular sign stand. The preferred embodiment consists primarily of a base portion attached to a breakaway column. The base portion is intended to be driven into the ground. The breakaway column supports an attached sign. The breakaway column is pierced by one or more breakaway holes at a position just above the ground. When the sign stand is struck by a moving vehicle, the one or more breakaway holes cause the breakaway column to fracture in a predictable fashion near its attachment to the base. Several embodiments are disclosed, including one forming the breakaway column and the base as one integral unit.

7 Claims, 6 Drawing Sheets

BREAKAWAY SIGN STAND

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of road signs. More specifically, the invention comprises a road sign stand having a specially designed base portion which allows it to break in a controlled fashion when struck by a vehicle.

2. Description of the Related Art

Roadside signs have been in common use for many decades. The use of portable signs to alert drivers as to construction zones and other hazards have become increasingly common. While these signs serve a useful purpose, they also present a hazard if struck. Accordingly, many prior art designs are configured to break away if struck by a moving vehicle.

BRIEF SUMMARY OF THE INVENTION

The present invention comprises a modular sign stand. It consists primarily of a base portion attached to a breakaway column. The base portion is intended to be driven into the ground. The breakaway column supports an attached sign. The breakaway column is pierced by one or more breakaway holes at a position just above the ground. When the sign stand is struck by a moving vehicle, the one or more breakaway holes cause the breakaway column to fracture in a predictable fashion near its attachment to the base. Several embodiments are disclosed, including one forming the breakaway column and the base as one integral unit.

REFERENCE NUMERALS IN THE DRAWINGS

| | | | |
|---|---|---|---|
| 10 | sign stand | 12 | base |
| 14 | breakaway column | 16 | horizontal stay |
| 18 | vertical stay | 20 | stay pivot |
| 22 | stay anchor | 24 | point |

-continued

| | | | |
|---|---|---|---|
| 26 | breakaway hole | 28 | bolt |
| 30 | fin | 32 | sign |
| 34 | stay pocket | 36 | ground |
| 38 | bolt hole | 40 | nut |
| 42 | impact force | 44 | fracture |

DESCRIPTION OF THE INVENTION

Figure 1:
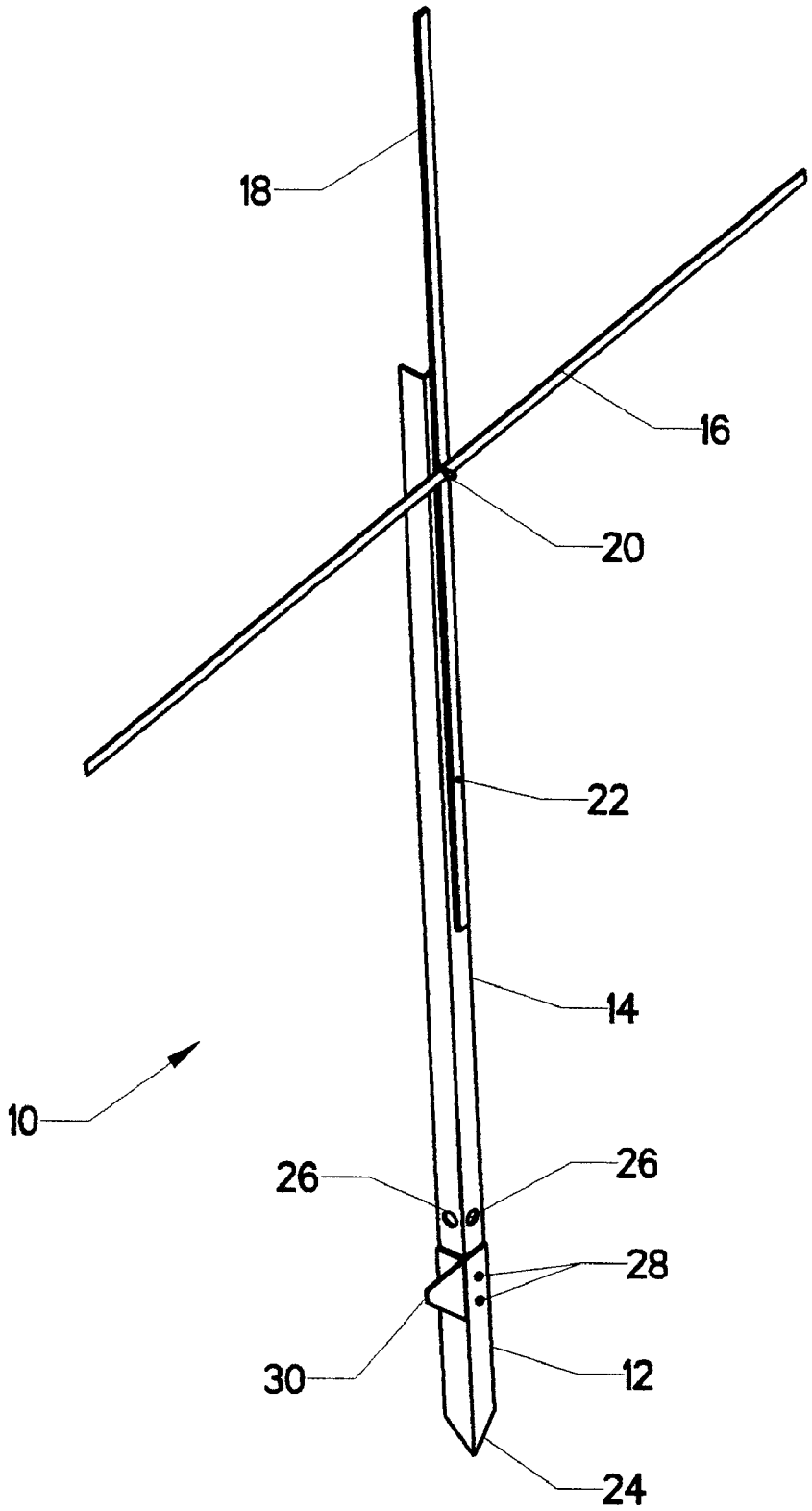
FIG. 1 is an isometric view, showing the proposed invention.

FIG. 1 shows sign stand 10 in its assembled state. Base 12 is configured to be inserted into the ground. Its lowest extremity is provided with point 24. Fin 30 extends out from the side of base 12. When installed, the top of fin 30 is typically at or just below ground level. For installation purposes, a user can step on fin 30 and press base 12 into the ground. Where harder soil is encountered, the user can strike the upper portion of fin 30 with a hammer in order to drive base 12 into the ground.

Breakaway column 14 is attached to base 12 by bolts 28. The use of bolts 28 is not particularly important to the invention. Many other types of fastening could be used—such as rivets, adhesives, or mechanical interlocking features. Breakaway column is tall and slender, extending from ground level as high as six feet or more. Features allowing the attachment of a sign are provided near its upper extreme. These are vertical stay 18 and horizontal stay 16. Vertical stay 18 is typically attached to breakaway column 14 in a fixed position—as shown (via stay anchor 22). However, horizontal stay 16 is pivotally attached at stay pivot 20. This feature allows horizontal stay 16 to be rotated 90 degrees so that it aligns with breakaway column 14 for convenient storage when the device is not in use. Many prior art methods can be used to attach the stays to breakaway column 14, including bolts, rivets, adhesives, etc.

Figure 2:
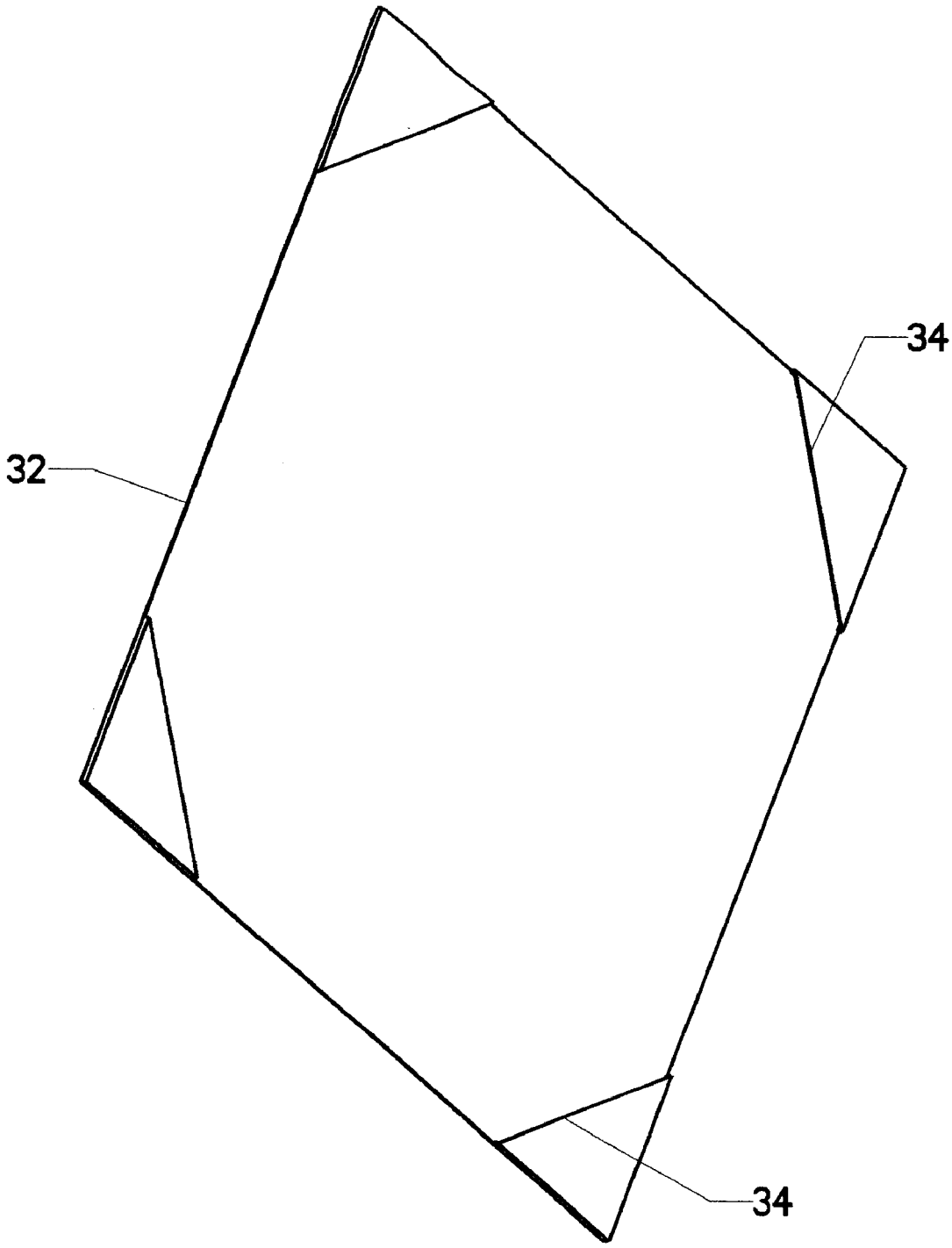
FIG. 2 is an isometric view, showing a typical sign.

FIG. 2 shows a typical sign 32. In this case, sign 32 is made of fabric mesh. It is attached to sign stand 10 by placing the tips of horizontal stay 16 and vertical stay 18 within the four stay pockets 34 on the rear side of sign 32. The stays are made of flexible material so that the tips can be bent and placed within stay pockets 34. If sign 32 is then appropriately sized, the stays will maintain tension on the fabric mesh, much like the structure of a kite.

Figure 3:
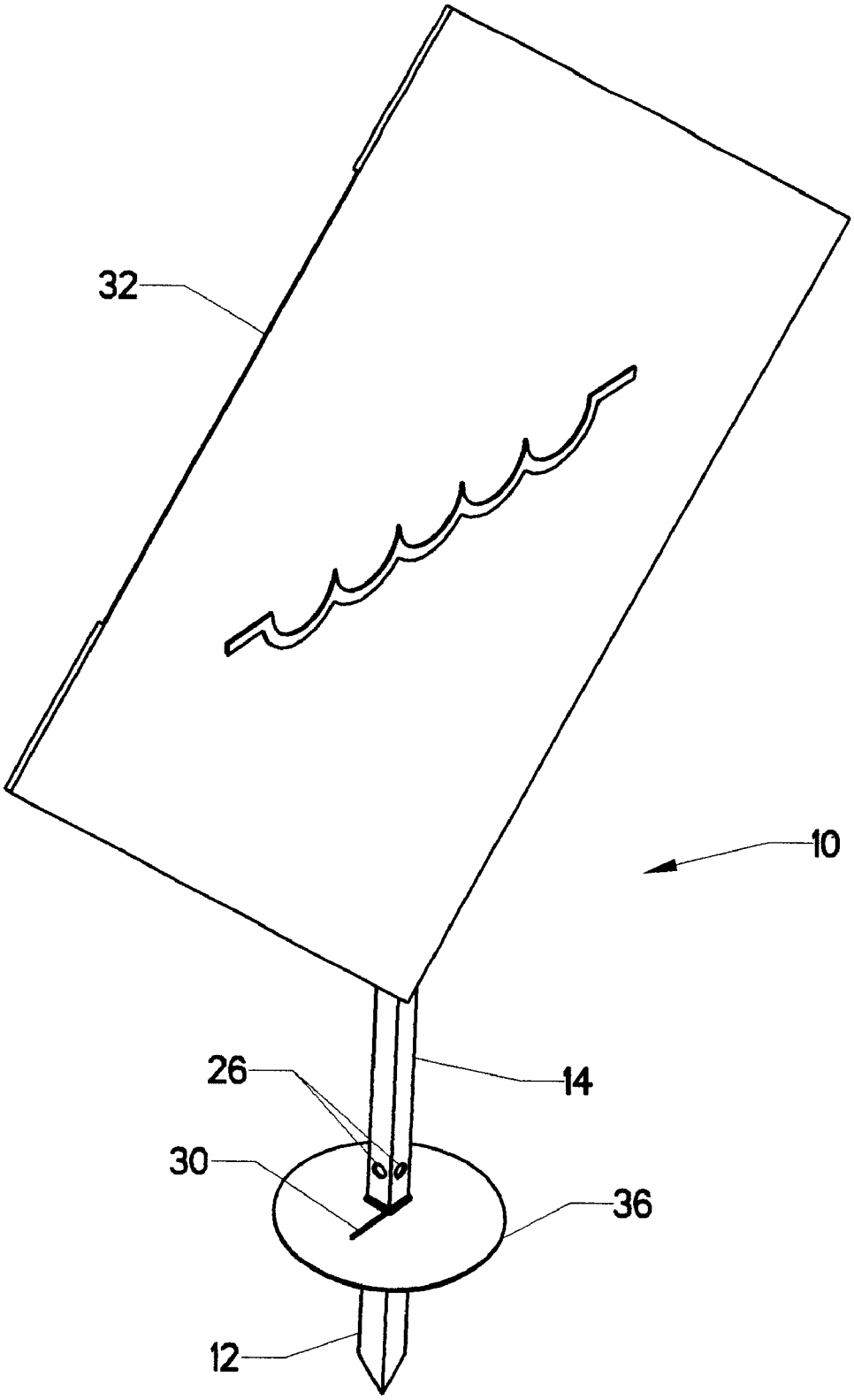
FIG. 3 is an isometric view, showing the proposed invention installed.

FIG. 3 shows sign stand 10 installed in ground 36 with sign 32 attached. The reader will observe that the upper extreme of base 12 is roughly even with ground 36. Breakaway column 14 extends upward from base 12 to mount sign 32. The reader will observe that the lower portion of breakaway column 14 is pierced by two breakaway holes 26 (one through each wall of breakaway column 14's L-shaped cross section). These features allow sign stand 10 to break in a predictable fashion, as will be explained shortly.

Figure 4:
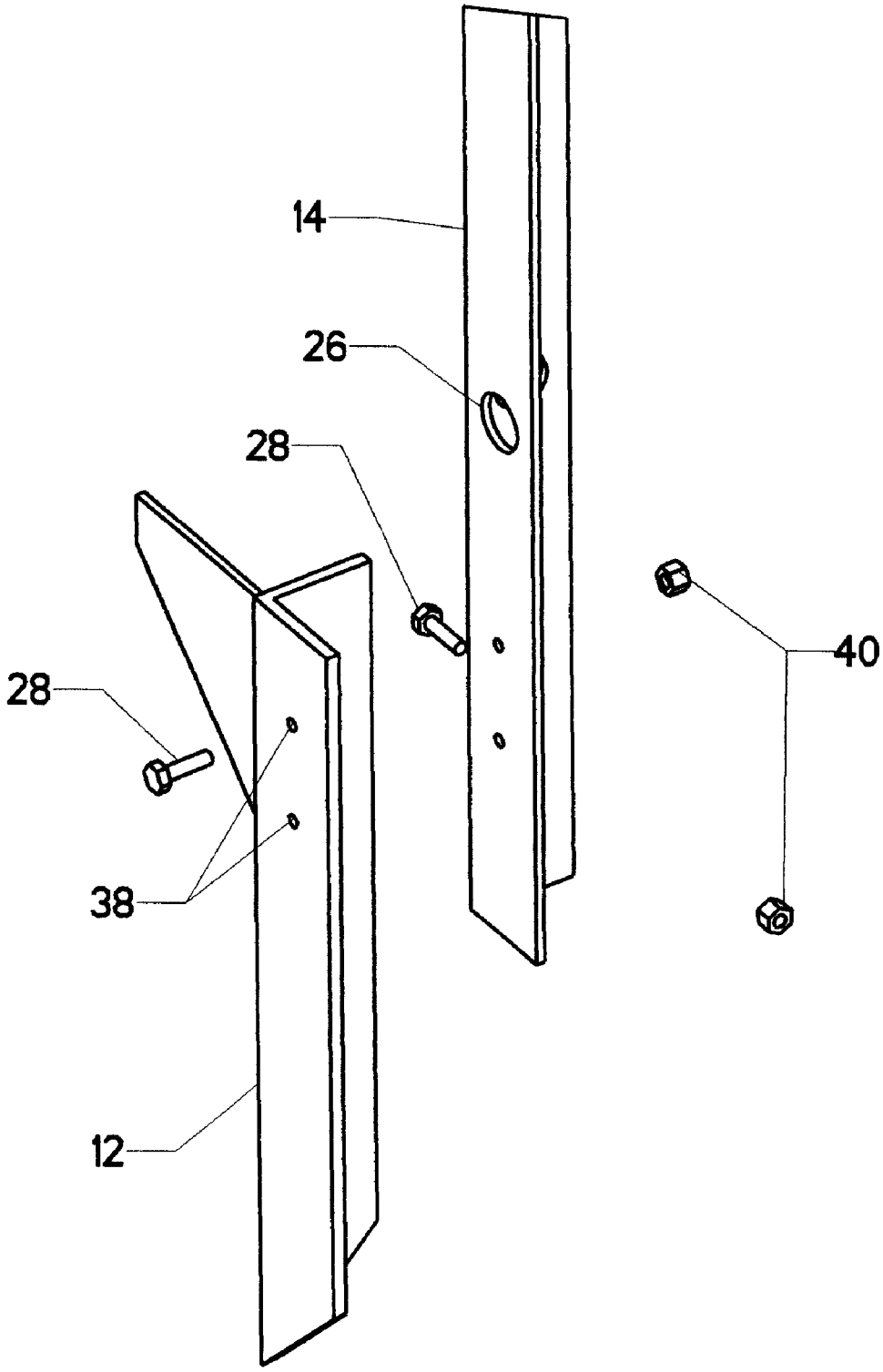
FIG. 4 is an isometric exploded view, showing how the base attaches to the breakaway column.

FIG. 4 shows details of how base 12 attaches to breakaway column 14. Bolt holes 38 are provided in both base 12 and breakaway column 14. Four bolts 28 and nuts 40 are used to lock the assembly together. The actual method of attachment is unimportant, so long as the lower extreme of breakaway column 14 is securely fastened to base 12.

Figure 5:
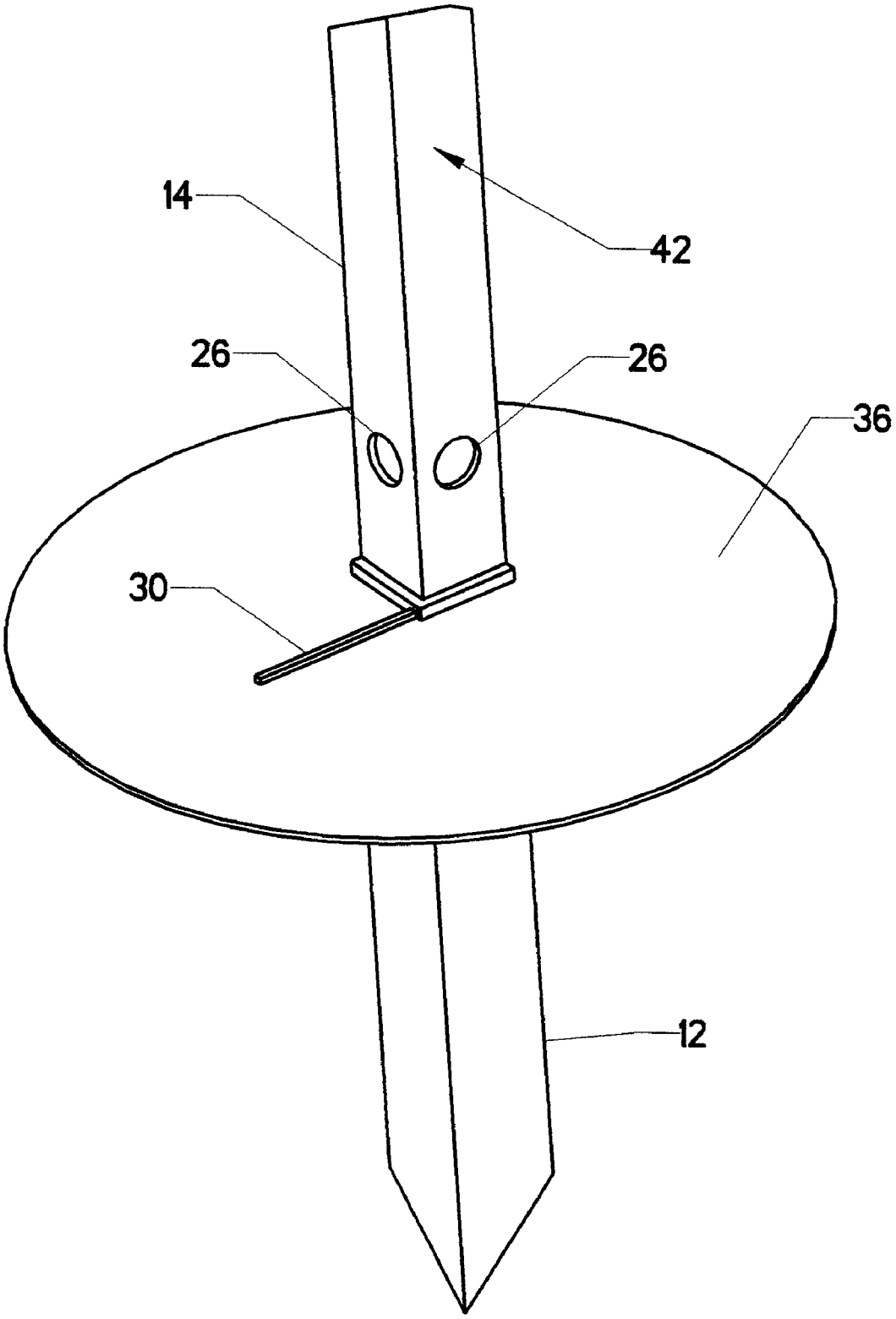
FIG. 5 is an isometric detail view, showing the lower portions of the invention as installed.

FIG. 5 shows the assembly installed in ground 36. If, at this point, a vehicle strikes sign stand 10, a substantial impact force is applied to breakaway column 14 (indicated as impact force 42). This force places a substantial bending moment on breakaway column 14. Base 12 tends to resist this bending moment, since it is anchored in the ground. Fin 30 also tends to secure base 12 by providing additional surface area for soil contact. Thus, the portion of breakaway column 14 which is attached to base 12 tends to remain fixed, whereas the upper portion tends to flex upon impact. The result is a concentration of stress around the two breakaway holes 26, since these features produce a considerably weakened cross section.

Figure 6:
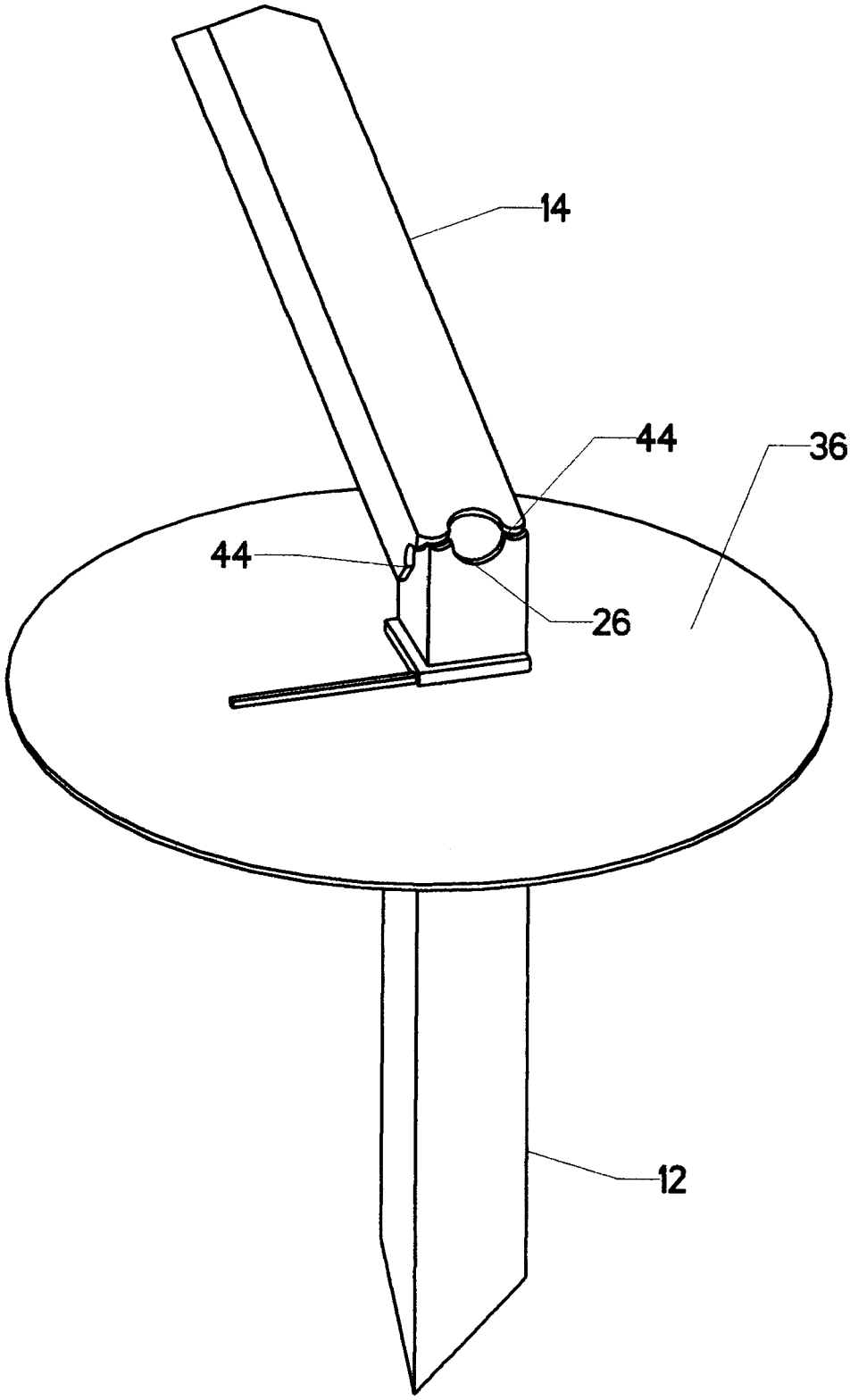
FIG. 6 is an isometric detail view, showing the lower portions of the proposed invention after fracturing.

FIG. 6 shows the result. Breakaway column 14 has fractured (fracture 44) through the two breakaway holes 26. This type of fracture occurs in a very controlled and predictable fashion. The placement of the two breakaway holes 26 force the fracture to occur just above ground level. The result is that breakaway column 14 bends over and passes safely under the vehicle striking the sign. No portion of breakaway column 14 passes over the vehicle (which would cause a hazard to the vehicle's occupants.

Material selection for the device is important. For best results (i.e., safest results), the material selected for breakaway column 14 should fracture without completely separating the two resulting sections. This action guarantees that the portion of breakaway stand 14 lying above fracture 44 will not become separated from the lower portion. Fracture 44 therefore acts like a hinge—it allows the column to fall over but will not allow it to tear free. If the column tore free, it could rotate upward and possibly strike the vehicle occupants.

Composite materials are particularly suitable for breakaway column 14. They are stiff and light, yet are sufficiently brittle to fracture predictably when breakaway holes 26 are introduced. In addition, the existence of reinforcing fibers in the composite materials prevent the separation of the two fractured components after impact. Many fibers will span fracture 44, holding the two pieces together.

Glass fiber reinforced plastics are effective in this application. Fiber orientation wilt of course, affect the fracture properties. Both a mat/roving fiber orientation and a unidirectional orientation (with the fibers aligned along the long axis of breakaway column 14) will work. Sample materials include glass reinforced ABS. Those sidled in the art will realize that many reinforcing fibers could be used other than glass. Glass is, however, generally very cost-effective. As high strength is not critical for this application, it is therefore a good choice.

Base 12 is ideally made of a tough material which can withstand extended use (including hammering). Steel, aluminum, or other metals are ideal for this component. An individual base 12 can be attached to a replacement breakaway column 14 if the original column is fractured. An individual base 12 can be used for many years.

Of course, those skilled in the art will know that breakaway column 14 and base 12 could be made as a single integral unit. Fin 30 then becomes simply another molded feature. However, because of the fact that fin 30 is subject to hammering, it is necessary to reinforce it with a tougher material—such as metal. A metal portion is ideally formed over the composite comprising fin 30. Those skilled in the art will realize that because the desired material properties for the breakaway column and the base are in opposition (one must be tough whereas the other is ideally somewhat brittle), it is advantageous to form them separately.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A breakaway sign stand for mounting a sign in the ground in a manner which allows it to break away if struck by a moving vehicle, comprising:

a. a base, made of a first material, having an upper portion and a lower portion, wherein said lower portion is pointed so that it can be driven into said ground, leaving said upper portion approximately level with said ground;

b. a breakaway column, made of a second material, having an upper portion and a lower portion, wherein said lower portion of said breakaway column is attached to said upper portion of said base;

c. mounting means, attached to said breakaway column proximate the upper end of said breakaway column for attaching said sign to said breakaway column;

d. a breakaway hole, passing completely through said breakaway column proximate said base and above the level of said ground, configured to substantially weaken said breakaway column proximate said base so that if said sign is struck by said moving vehicle, said breakaway column will fracture proximate said breakaway hole into a first portion which remains attached to said base and a second portion which is angularly displaced from said first portion;

e. wherein said first material is a tough metal; and f. wherein said second material is a plastic reinforced with elongated fibers, so that when said breakaway column fractures, said elongated fibers prevent the complete separation of said second portion from said first portion.

2. A breakaway sign stand as recited in claim 1, wherein said second material is stiff but brittle, so that said column will remain rigid when installed but will fracture easily when struck by said moving vehicle.

3. A breakaway sign stand as recited in claim 1, wherein said mounting means comprises:

a. a vertical stay; and b. a horizontal stay, having a left end, a middle, and a right end, being pivotally attached to said breakaway column proximate said middle, so that said horizontal stay can rotate between a vertical orientation, wherein it is aligned with said breakaway column for efficient storage of said breakaway sign stand, and a horizontal orientation, where it can be attached to said sign.

4. A breakaway sign stand as recited in claim 1, wherein:

a. said breakaway column comprises:

I. a first wall; and ii. a second wall, oriented perpendicularly to said first wall and attached thereto; and b. wherein said breakaway hole passes completely through said first wall.

5. A breakaway sign stand as recited in claim 4, further comprising a second breakaway hole, passing completely through said second wall proximate said base and above the level of said ground.

6. A breakaway sign stand as recited in claim 5, wherein said second material is stiff but brittle, so that said column will remain rigid when installed but will fracture easily when struck by said moving vehicle.

7. A breakaway sign stand as recited in claim 5, wherein said mounting means comprises:

a. a vertical stay; and b. a horizontal stay, having a left end, a middle, and a right end, being pivotally attached to said breakaway column proximate said middle, so that said horizontal stay can rotate between a vertical orientation, wherein it is aligned with said breakaway column for efficient storage of said breakaway sign stand, and a horizontal orientation, where it can be attached to said sign.

* * * * *